US005328056A

United States Patent [19]

Schneider et al.

[11] Patent Number: 5,328,056

[45] Date of Patent: Jul. 12, 1994

[54] TUBE AND DISTRIBUTOR INCORPORATING THE LATTER FOR STORING AND DISTRIBUTING TWO CREAMY OR PASTY PRODUCTS

[75] Inventors: Bernard Schneider; Michel Rebeyrolle, both of Sainte Menehould, France

[73] Assignee: Cebal S.A., Clichy, France

[21] Appl. No.: 31,499

[22] Filed: Mar. 15, 1993

[30] Foreign Application Priority Data

Mar. 16, 1992 [FR] France ..... 92 03326

[51] Int. Cl.[5] ..... B65D 35/22

[52] U.S. Cl. ..... 222/94

[58] Field of Search ..... 222/94, 145, 129

[56] References Cited

U.S. PATENT DOCUMENTS

| | | | |
|---|---|---|---|
| 1,699,532 | 1/1929 | Hopkins | 222/94 |
| 2,935,231 | 5/1960 | Paull et al. | 222/94 |
| 2,944,704 | 7/1960 | Taylor, Jr. | 222/94 |
| 2,959,327 | 11/1960 | Bloom | 222/94 |
| 3,135,428 | 6/1964 | Gallo, Sr. | 222/94 |
| 3,331,535 | 7/1967 | Jarvis | 222/94 |
| 3,876,111 | 4/1975 | Swain | 222/94 |
| 4,585,149 | 4/1986 | Zulauf | 222/94 |
| 4,969,767 | 11/1990 | Madden | 222/94 |
| 5,076,470 | 12/1991 | Hatakeyama et al. | 222/94 |

FOREIGN PATENT DOCUMENTS

| | | | |
|---|---|---|---|
| 577523 | 9/1924 | France . | |
| 60-188150 | 12/1985 | Japan | 222/94 |
| 891027 | 3/1962 | United Kingdom . | |
| 1385924 | 5/1975 | United Kingdom . | |

*Primary Examiner*—Kevin P. Shaver

*Attorney, Agent, or Firm*—Dennison, Meserole, Pollack & Scheiner

[57] ABSTRACT

The invention relates to a tube (1) having a neck (2) with a distribution orifice (3). The neck (2) being followed by a shoulder (4) and a flexible skirt (5) and, above the skirt (5). The neck (2) has an external, annular, tight fixing element (10, 30) for an external neck (27) by engagement and in that neck (2) which comprises two chambers (6, 7). The chambers are tight with respect to one another up to the distribution orifice (3). The first (6) communicating with the interior (8) of the skirt (5) of the tube (1) and the second (7) carrying through side window or windows (9). The invention also relates to the distributor obtained by engaging an external tube on the tube. It is used for the storage and distribution, without prior contact, of pairs of products in the pharmaceutical, cosmetic, food or cleaning industries.

16 Claims, 3 Drawing Sheets

TUBE AND DISTRIBUTOR INCORPORATING THE LATTER FOR STORING AND DISTRIBUTING TWO CREAMY OR PASTY PRODUCTS

BACKGROUND OF THE INVENTION

Field of the Invention

The Present Invention relates to a tube and double wall distributor having said tube in its interior, the thus formed apparatus permitting the storage and distribution of two creamy or pasty products having to be kept separate up to the time of their distribution, e.g. two pharmaceutical products.

FR 655134 published in 1929 discloses a double wall tubular distributor for simultaneously distributing two or more pasty substances. According to a variant, said distributor is formed by an inner tube and an outer tube interconnected at the base of their necks, the communication between the two tubes for the simultaneous distribution of the two products taking place by means of orifices of the inner tube, located below the neck and in the upper part of the tube shoulder (drawing). The inner tube consequently has a neck with a distribution orifice, said neck being followed by a shoulder and a flexible skirt and above the latter one or more through side windows, the neck having an annular external means for the tight fixing of an external neck. In the apparatus obtained, whose internal and external tubes are fixed together by their necks, the side windows issue onto the annular gap between the two tubes.

By convention in the present application, the tubes are described with their tops or heads upwards, the longitudinal axis of each tube and/or the apparatus incorporating the same being assumed as vertical.

The aforementioned document gives no information on the method and procedure for assembling the two tubes and it relates to the distribution of at least two products mixed in the opening of the apparatus and in this case the neck of the internal tube.

The Applicant has aimed at developing a distributor of the double wall type able to keep separate two creamy or pasty products up to their distribution orifice, said tube being preferably easy to manufacture and adjust.

SUMMARY OF THE INVENTION

The invention therefore relates to a tube having a neck with a distribution orifice, said neck being followed by a shoulder and a flexible skirt and, above the said skirt, one or more through side windows, the neck having annular external means for the tight fixing of an external neck, characterized in that said neck comprises two chambers tight with respect to one another up to said distribution orifice, the first of said chambers being linked with the interior of the skirt of said tube and the second chamber carrying the through side window or windows, which are located at a lower part the neck and above the said shoulder, which forms the bottom of the second chamber.

This design of the tube to form the internal tube of the storage and distribution apparatus to be produced makes it possible to use a standard external tube, or a tube which is only slightly modified by adding an internal annular relief having to cooperate with the annular external means for the tight fixing of the neck of the internal tube described hereinbefore. This cooperation not only leads to the necessary sealing, but also to the height fixing of the external tube with respect to the internal tube and therefore the width or height of the annular gap defined by the two tubes level with their shoulders. It can be seen that this height regulation and the good seating of the external tube can be fixed or improved by the presence of ribs typically arranged in star-like manner on the shoulder of the internal tube. The interior of the neck is subdivided into two chambers, the first issuing in the interior of the skirt where the first product is to be stored and the second being supplied by its through side windows.

The preferred characteristics of the tube or inner tube according to the invention will be explained in greater detail relative to exemplified embodiments and the attached drawings.

The invention also relates to an apparatus for the storage and distribution of two creamy or pasty products, formed from the aforementioned internal tube in accordance with any one of its definitions and an external tube, whose neck is engaged on the neck of the internal tube and having an annular, internal fixing means, which then cooperates with the annular, tight, external fixing means of said internal tube neck, the through side windows issuing onto the annular gap between the two tubes.

The preferred means for fixing together the two tubes for forming the distributor will be described in exemplified manner hereinafter.

For the use of said distributor, the lower ends of the two tubes are welded following the filling of the skirt of the internal tube and the annular gap, the welded end of said skirt of the internal tube remaining within the skirt of the welded external tube. The two creamy or pasty products prepared in this way preferably have a relative viscosity difference not exceeding 20% and preferably viscosities respectively exceeding 6000 mPa.s (6000 cP), so that the corresponding products are not then liable to flow from the orifice of one chamber towards that of the other chamber on straightening the distributor after carrying out a distribution of products by downwardly inclining its double neck and pressing on its external skirt. The neck is then closed by a cap, whose base bears tightly on the orifice, i.e. on the end orifices of the two chambers and on the top of the median partition separating the same, in such a way that there is no contamination of one product by the other for the products remaining stored in the distributor, or by a cap whose internal sealing means incorporate two parts which are respectively engaged in the ends of the two chambers of the neck.

The internal tube is preferably made from polyolefin, typically polypropylene or polyethylene and can e.g. be manufactured by injection moulding. The external tube, which is of standard manufacture or is only slightly modified by the addition of an annular rib on the inside of the neck, is either made from polyolefin, or from any other material used for a flexible tube and it can e.g. be an aluminium tube.

ADVANTAGES OF THE INVENTION

Ease of manufacture of the distributor, the internal tube alone having a special construction and the two tubes being assembled with one another by engagement up to a stop of the snapping type or of the abutment type on ribs of the shoulder of the internal tube, said stop easily being automated.

Ease of regulating the proportions and flow rates of the product, respectively by positioning the partition separating the two chambers and the opening of the through windows and the spacing apart of the shoulders of the two tubes.

Obtaining a storage without inclusion of air in the products as a result of means for slowing down the return of the products following a distribution.

EXAMPLE 1 (FIGS. 1 AND 2)

Figure 1:
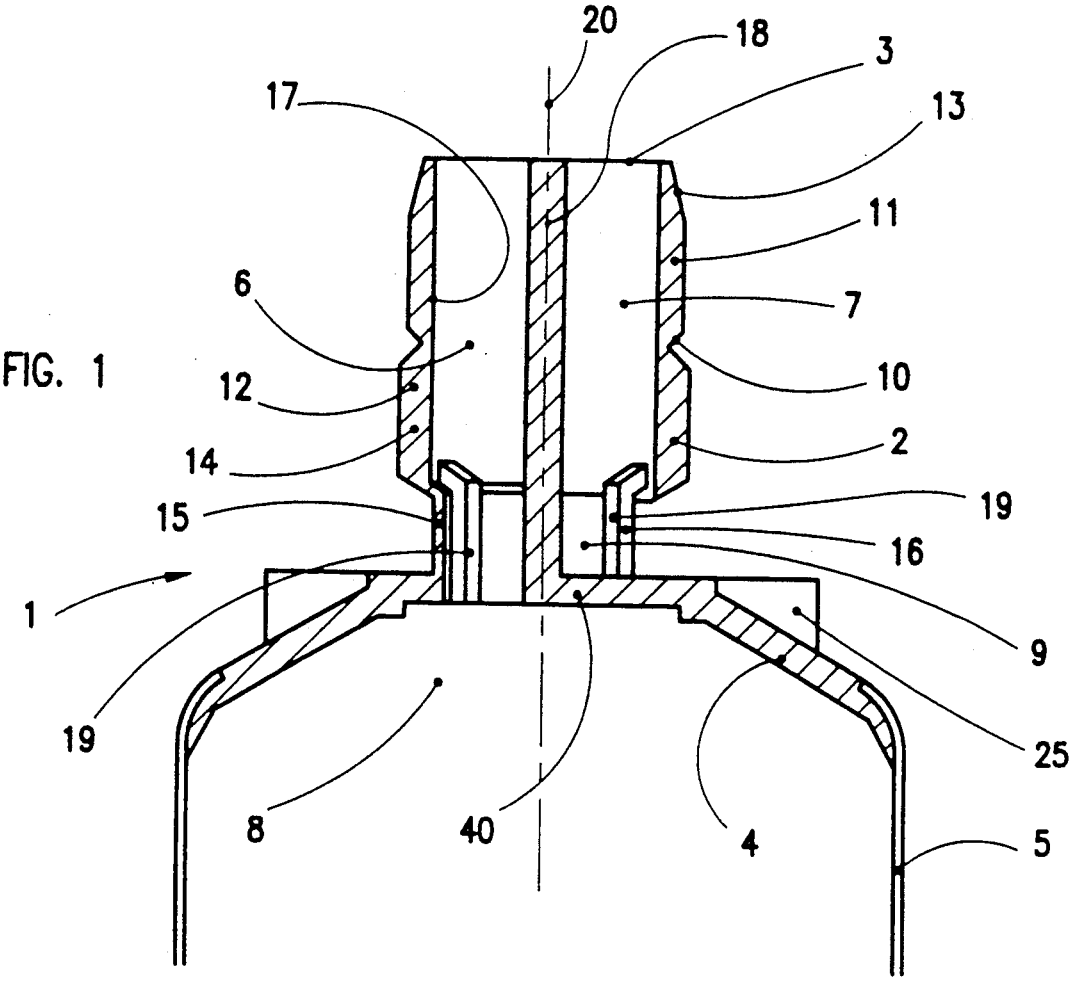
FIG. 1 shows a first or internal tube according to the invention in axial section.

1a) The tube 1 has a neck 2 with a distribution orifice 3, followed by a shoulder 4 and a flexible skirt 5. This neck comprises two chambers 6, 7, which are tight or sealed with respect to one another, the first chamber 6 communicating with the interior 8 of the skirt 5 and the second chamber 7 having through side windows 9. The neck 2 has at mid-height an annular groove 10 permitting the tight fixing in position of an external neck, by snapping engagement of a complementary rib into the groove 10. The through windows 9 are located at the base of the neck 2 and above the shoulder 4.

In this case the neck and the shoulder are made from PE injection moulded on the upper end of the skirt 5, its external diameter being 10.3 mm in the upper part 11 above the groove 10 and 10.8 mm in its lower part 12 below said groove. The upper part 11 starts with a truncated cone-shaped chamfer 13, in order to facilitate the engagement of an external neck (cf. FIG. 5), the snapping fixing the position of said neck and reinforcing the seal obtained by locking fitting of the lower part 12.

1b) The first chamber 6 of the neck 2 has an external wall 14 connected to the shoulder 4 by a cover or imperforate collar portion 15 with a thickness below 0.6 mm, said thickness preferably being between 0.05 and 0.5 mm and in even more preferred manner between 0.15 and 0.3 mm, the external diameter of said cover preferably being smaller than the internal diameter of the first chamber 6. In this case the cover 15 has a thickness of 0.2 mm. Its limited thickness and its set back or recessed position with respect to the top of the neck 2 act together in order to prevent shrinkage deformations of the tube moulding, by isolating said upper thick part of the neck 2 forming a ring 11 and 12 with respect to the shoulder 4 moulded on the skirt 5. The cover or collar portion 15 provides for communication of chamber 6 solely with interior 8 of skirt 5. Windows 9, without a cover, communicate chamber 7 solely with the exterior of skirt 5.

1c) The neck 2 preferably has a height above the windows 9 at least equal to twice the equivalent diameter of the largest cross-section of the two chambers. Tests have shown that this condition makes it possible to slow down the products falling along the inner walls of the neck 2 to an adequate extent to ensure that there is no air return.

In this case application is as follows. The second chamber 7 has an inwardly curved wall of radius 4 m and a cross-section of $1.57 \times 16 = 25.1$ mm$^2$, the diameter of the circle of the same surface or equivalent diameter is $(25.1 \times 4/3.14)^{0.5} = 5.65$ mm. The height of the neck 2 above the windows 9 is 12.5 mm, i.e. 2.2 times the equivalent diameter of 5.65 mm. The tests carried out with the distributor of FIG. 5 and several pairs of creamy and pasty products compared with tubes having shorter necks confirmed the absence of an air return on running back of the products following distribution, so that these products can be preserved better in the closed distributor. For simplification purposes the effect of the median partition has been ignored, thereby slightly reducing the cross-section of each chamber.

1d) Preferably with respect to conditions (1b) and (1c), the neck 2 of tube 1 comprises the ring portion 11, 12, which is not perforated and which carries the annular fixing means 10 connected to the connecting portion 16 incorporating the cover 15 and the windows 9. This connecting portion has transverse dimensions, i.e. a diameter and overall widths equal to or below the diameter or diameters of the interior 17 of said ring portion 11 and 12. The neck 2 is split into two chambers 6 and 7 by the intermediate partition 18 centred on the longitudinal axis 20 of the neck 2 and the tube 1 and continuously connected to the shoulder 4, which forms the base 40 of the second chamber 7.

The set back position of the complete connecting portion 16 is favourable to the absence of distortion on contraction following moulding. The median partition 18 has a thickness between 0.5 and 1.2 mm. In this case the partition 18 has a thickness of 0.85 mm and the shoulder 4 is rigid with a thickness of its central horizontal portion 40 forming the base of the chamber 7 equal to 1 mm.

1e) The two chambers 7 and 6 internally carry axial ribs 19 extending from the shoulder 4 up to respectively the top of the through windows 9 and the top of the cover 15. These ribs 19 contribute to the deceleration of the products during their running down. They also contribute to the rigidity of the connecting portion 16 and thus to the absence of distortion of the moulded assembly 2 and 4 after shrinkage. They here form the vertical sides of the three through windows 9, having the shape of rectangles with a curvilinear, horizontal upper edge, whilst in this way rigidifying the neck 2.

EXAMPLES 2 AND 3 (FIGS. 3 AND 4)

Figure 3:
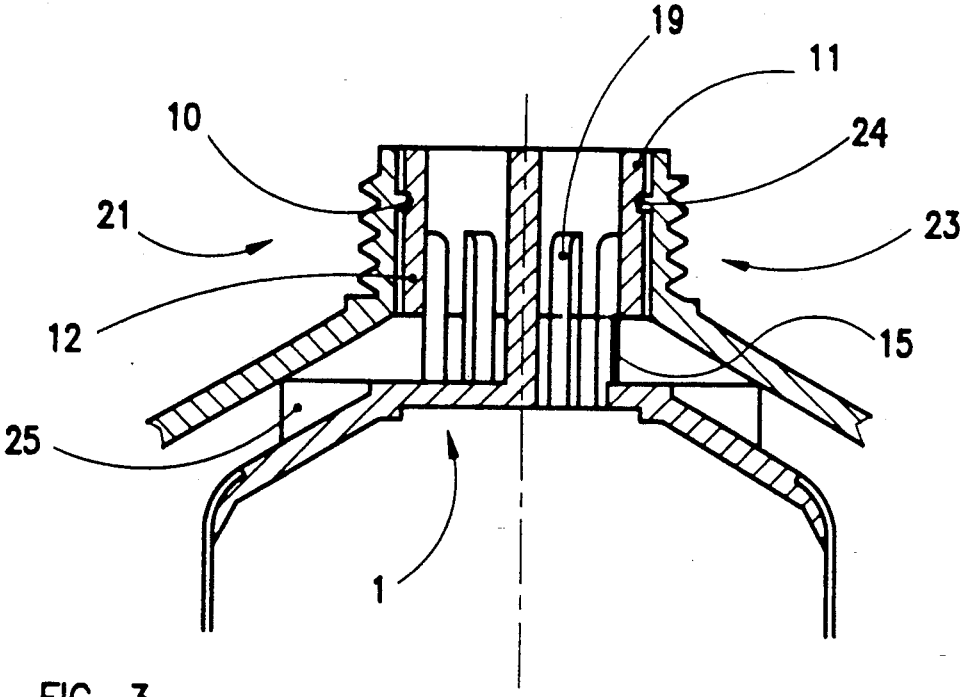
FIGS. 3 and 4 partly show two distributors according to the invention, respectively in axial section and in axial half-section.
Figure 4:
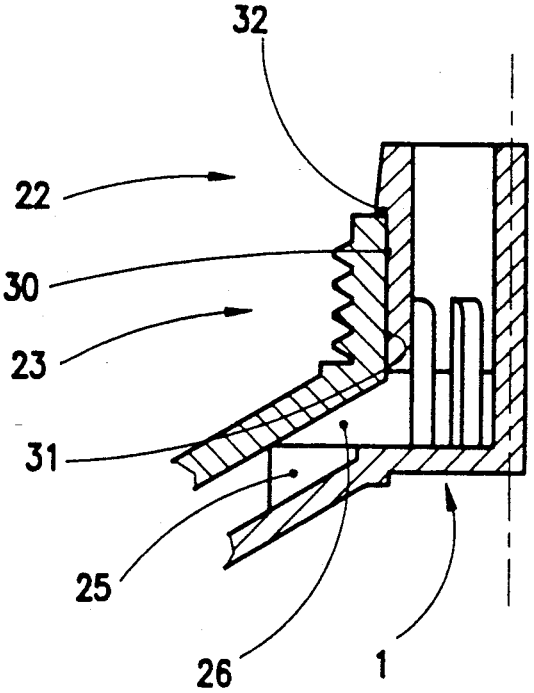

Each of the distributors 21 and 22 of FIGS. 3 and 4 are formed by an internal tube 1 having the general characteristics described in (1a, 1b, 1d, 1e).

2a) The internal tube 1 of the distributor 21 has a neck with a less high annular portion 11, 12 than in example 1, whereas its consolidating and decelerating ribs 19 rise to 0.4 times the height of said ring 11 and 12 and the air returns described hereinbefore are relatively limited. The tube 1 and the external tube 23 respectively carry a groove 10 and a rib 24 by which they are snapped together in a predetermined relative position, their cylindrical engagement being forced and tight and in particular takes place by their cylindrical surfaces located below these snapping reliefs, namely 30 and 31 in FIG. 4.

2b) The distributor 22 has an internal tube 1 and a standard external tube 23 assembled by fitting into one another, comprising the snapping of the external tube 23 below the annular shoulder 32 below a truncated cone-shaped engagement of the internal tube 1 and with the forcing of the cylindrical contact surfaces of the two tubes 1 and 23 below the said shoulder 32, The shoulder 4 of the tube 1 carries in this case radial ribs 25 arranged in star-like manner and which serve as an abutment for the embedding of the external tube 23, They here have a determinative function for the stopping of said embedding or insertion and for regulating the width of the annular gap 26 between the tubes level with the shoulder 4.

Abutment or stop ribs 25 (FIGS. 1 to 3) are also preferably used in the aforementioned cases and then contribute to the stopping of the insertion by machine avoiding force action on the annular fixing 24 and 10 of the two necks.

EXAMPLE 4 (FIG. 5)

Figure 2:
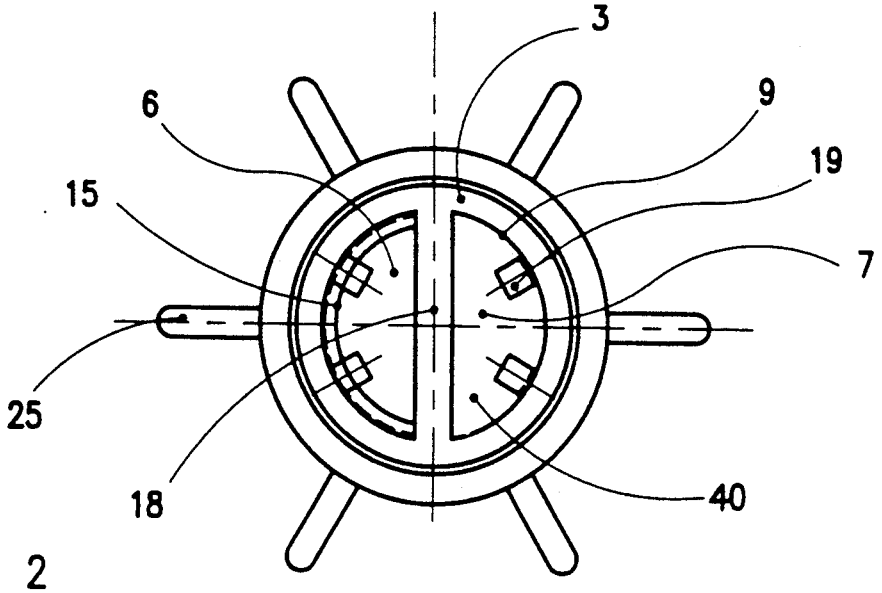
FIG. 2 is a partial plan view of the first tube.
Figure 5:
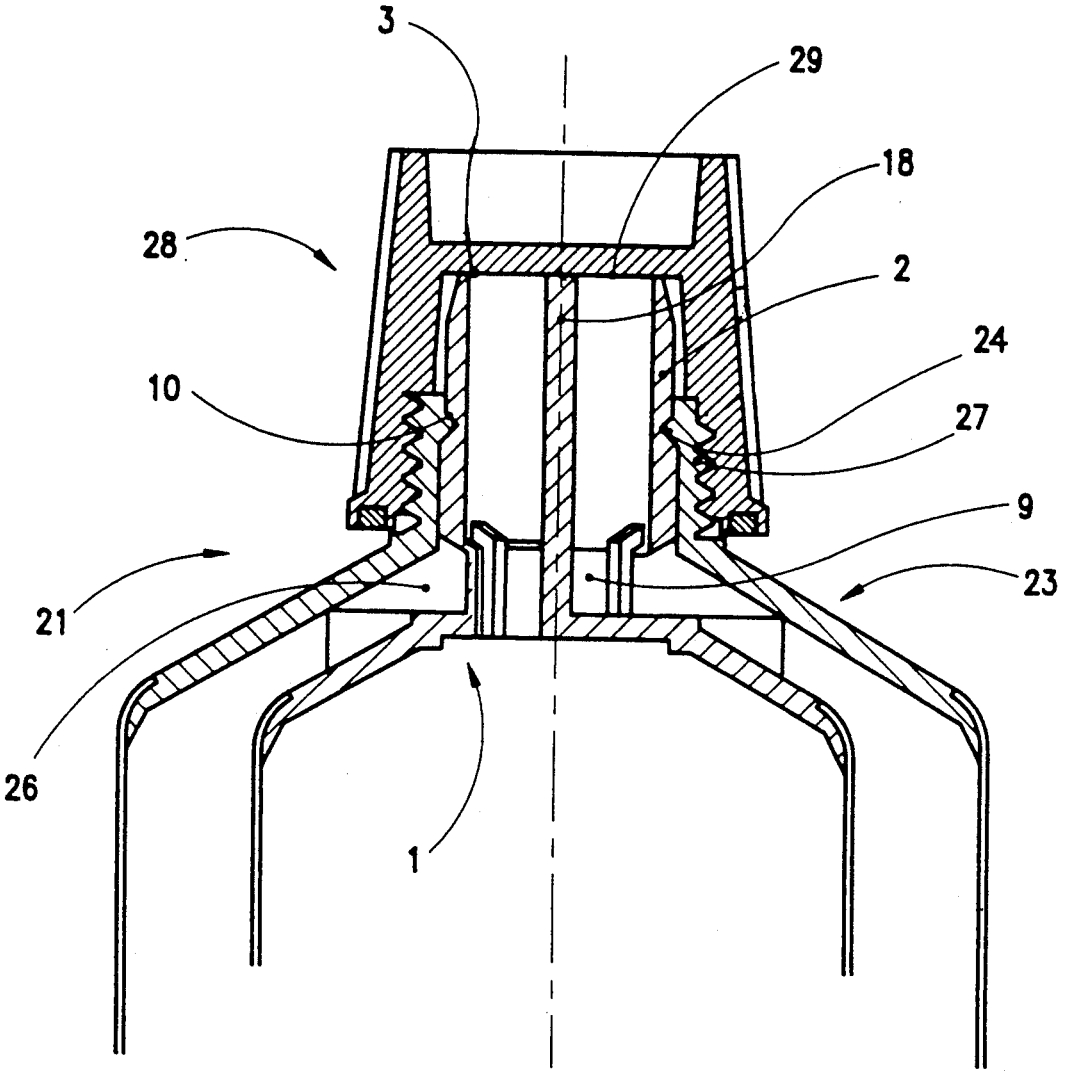
FIG. 5 shows a third distributor formed from the first tube, plugged by a cap for delivery to a customer and in axial section.

The distributor 21 of FIG. 5 is formed by the tube 1 of FIG. 1 and an external tube 23 only differing from the external tube of FIG. 3 by the geometry of its annular fixing rib 24, which here has a V-shaped cross-section complimentary to that of the groove 10 of FIG. 1.

According to its most general definition, the distributor 21 is formed by an internal tube 1 according to the invention and an external tube 23 having a neck 27 engaged on the neck 2 of the internal tube 1 and having an internal, annular fixing means 24 which then cooperates with the annular, tight, external fixing means 10 of the neck 2 of the internal tube 1, the through side windows 9 of the tube 1 issuing onto the annular gap 26 between the two tubes 1 and 23.

When said annular means 24 and 10 cooperating for the fixing together of the two necks 27 and 2 are reliefs which interengage, they are in themselves able to solve the sealing problem level with the annular gap 26. As shown by the examples, it is preferable according to the invention to also have a cylindrical or truncated cone-shaped forced engagement, giving a supplementary sealing and stability guarantee.

The sealing cap 28 screwed onto the external neck 27 has a base 29, which in the closed position tightly bears on the orifice 3 and on the free end edge of the median partition 18.

TESTS WITH PAIRS OF PRODUCTS TO BE DISTRIBUTED

With identical distributors according to FIG. 5, filling and distributing tests are carried out with pairs of products having the same viscosity varying between 10000 and 50000 mPa.s and pairs of products of different viscosities.

PAIRS OF PRODUCTS WITH THE SAME VISCOSITIES

For each pair will firstly be indicated the product of the internal tube, followed by the product contained in the annular gap:

- active cream of 10000 mPa.s and neutral cream of the same viscosity, giving after distribution and mixing a hand treatment cream;
- gel containing a carbonate and cleansing gel, both of 20000 mPa.s, which together give a dentifrice treatment gel;
- separate viscous creams, each of 30000 mPa.s, giving a treatment cream;
- separate viscous creams, each of 50000 mPa.s It is pointed out that for viscosities exceeding 20000 mPa.s, distribution by pressing of the external skirt of the distributor gives two separate ribbons, which do not stick together, but which can be mixed on application as a result of the mixing action produced by said application.

PAIRS OF PRODUCTS OF DIFFERENT VISCOSITIES

Conclusions of these tests:

- up to 10000 mPa.s the viscosity difference of the two products can be up to 20% relative;
- at 50000 mPa.s the viscosity difference can be max. 5% relative;
- above 10000 mPa.s, the maximum viscosity difference must decrease linearly, e.g. must be 12.5% for 30000 mPa.s.

When the viscosity difference exceeds the thus defined maximum value, one of the products passes out faster than the other during distribution. An at least partial compensation is possible by relative geometrical modifications of the two chambers 6 and 7 (FIG. 1), the chamber for the more viscous product being made wider than the chamber for the less viscous product.

INDUSTRIAL APPLICATIONS

Storage and distribution of pairs of pharmaceutical, cosmetic, food or cleansing products, the products of said pairs not being contactable prior to their distribution.

We claim:

1. A distributor including a tube (1) having a neck (2) with a distribution orifice (3), said neck (2) being followed by a shoulder (4) defining an interior for a product to be dispensed, and a flexible skirt (5), said neck (2), above the said skirt (5), having at least one through side window (9), the neck (2) having annular external fixing means (10, 30), wherein said neck (2) comprises two chambers (6, 7) sealed with respect to one another up to said distribution orifice (3), the first (6) of said chambers having an external wall (14) connected to said shoulder (4) by a recessed collar portion (15) having a thickness below 0.6 mm, so as to prevent shrinkage deformations during the moulding of said tube (1), said first chamber being communicated with the interior (8) of the skirt (5) of said tube (1) by said recessed collar portion, and the second chamber (7) communicating with said at least one through side window (9), located at the base of the neck (2) and above said shoulder (4), said shoulder forming the bottom of the second chamber (7).

2. The distributor according to claim 1, wherein said collar portion (15) has an external diameter smaller than the internal diameter of the external wall (14) of the first chamber (6) and a thickness between 0.05 and 0.5 mm.

3. The distributor according to claim 2, wherein the collar portion (15) has a thickness between 0.15 and 0.3 mm.

4. The distributor according to claim 1, wherein said neck (2) comprises an unperforated, annular portion (11, 12) externally carrying said annular fixing means (10, 30) and connected to a connecting portion (16) linked with the shoulder (4) having a diameter and overall width at the most equal to the internal diameter of said annular portion (11, 12), said neck (2) being subdivided into the two chambers (6, 7) by a substantially axial intermediate partition (18) continuously connected to a portion (40) of the shoulder (4) forming the bottom (40) of the second chamber (7), said connecting portion (16) incorporating the recessed collar portion (15) of the first chamber (6) and at least one through window (9) of the second chamber (7).

5. The distributor according to claim 4 wherein said tube comprises an internal tube, said distributor including an external tube (23), said external tube (23) having a neck (27) engaged onto the neck (2) of said internal tube (1) and having an annular, internal fixing means (24, 31), which cooperates with the said neck (2) of the internal tube (1) and said at least one through side window (9) opening to an annular gap (26) between the two tubes (1 and 23).

6. The distributor according to claim 1, wherein said annular external fixing means (10, 30) is at least one of an annular surface (30) for force fitting, a rib and an annular ratching groove (10).

7. The distributor according to claim 6, wherein the shoulder (4) of the tube (1) carries ribs (25) which, with said fixing means (30), serve as stop and spacing abutments (25) for an external tube (23).

8. The distributor according to claim 1, wherein the neck (2) of the tube (1) has a height above said at least one window (9) at least equal to twice the equivalent diameter of the largest cross-section (7) of said two chambers (6 and 7).

9. The distributor according to claim 8, wherein said two chambers (6, 7) of the tube (1) internally carry axial ribs (19) extending from said shoulder (4) up to at least respectively the top of said at least one through window (9) and the top of said collar portion (15).

10. The distributor according to claim 9, wherein multiple through side windows (9) are provided, selected ones of said axial ribs (19) defining said windows (9) and rigidify the neck (2).

11. The distributor according to claim 8 wherein said tube comprises an internal tube, said distributor including an external tube (23), said external tube (23) having a neck (27) engaged onto the neck (2) of said internal tube (1) and having an annular, internal fixing means (24, 31), which cooperates with the said neck (2) of the internal tube (1) and said at least one through side window (9) opening to an annular gap (26) between the two tubes (1 and 23).

12. The distributor according to claim 11 wherein said two chambers (6, 7) of the internal tube (1) internally carry axial ribs (19) extending from said shoulder (4) up to at least respectively the top of said at least one through window (9) and the top of said collar portion (15).

13. The distributor according to claim 1, wherein said tube comprises an internal tube, said distributor including an external tube (23), said external tube (23) having a neck (27) engaged onto the neck (2) of said internal tube (1) and having an annular, internal fixing means (24, 31), which cooperates with the said neck (2) of the internal tube (1) and said at least one through said window (9) opening to an annular gap (26) between the two tubes (1 and 23).

14. The distributor according to claim 13, wherein said annular fixing means (24, 10) of the neck (2) of the external tube (23) and the neck (2) of the internal tube (1) respectively incorporate a complementary rib (24) and groove (10).

15. The distributor according to claim 13, wherein said annular fixing means (31, 30) of the neck (9) of the external tube (23) and the neck (2) of the internal tube (1) are respectively annular surfaces (31, 30) which engage and frictionally lock.

16. The distributor according to claim 15, wherein the external ribs (25) carried by the shoulder (4) of the internal tube fix the position of said external tube (23) on the internal tube and define the width of said annular gap (26) between the tubes upon engagement of said tubes.

* * * * *

UNITED STATES PATENT AND TRADEMARK OFFICE

CERTIFICATE OF CORRECTION

PATENT NO. : 5,328,056

DATED : July 12, 1994

INVENTOR(S) : Bernard Schneider et al

It is certified that error appears in the above-indentified patent and that said Letters Patent is hereby corrected as shown below:

Column 8, line 17, "said" (second occurrence) should read --side--.

Column 8, line 26, "(9)" should read --(27)--.

Signed and Sealed this

Twentieth Day of September, 1994

*Attest:*

*Attesting Officer*

BRUCE LEHMAN

*Commissioner of Patents and Trademarks*